United States Patent [19]

Wilson

[11] 4,318,560

[45] Mar. 9, 1982

[54] TOBACCO SUPPORTING TINE STRUCTURE WITH IMPROVED LOCKING MEANS

[75] Inventor: Robert W. Wilson, Charlotte, N.C.

[73] Assignee: Powell Manufacturing Company, Inc., Bennettsville, S.C.

[21] Appl. No.: 141,762

[22] Filed: Apr. 21, 1980

[51] Int. Cl.[3] ..... A24B 1/08

[52] U.S. Cl. ..... 294/5.5; 414/26

[58] Field of Search ..... 294/5.5; 34/236; 56/27.5; 211/54.1, 59.1, 123–125; 414/26; 432/500

[56] References Cited

U.S. PATENT DOCUMENTS

| | | | |
|---|---|---|---|
| 3,095,230 | 6/1963 | Long | 414/26 X |
| 3,251,620 | 5/1966 | Hassler | 294/5.5 |
| 3,767,248 | 10/1973 | Horne | 294/5.5 |
| 4,032,023 | 6/1977 | MacIntosh | 294/5.5 X |
| 4,036,454 | 7/1977 | Jordan et al. | 414/26 X |
| 4,136,465 | 1/1979 | Wilson | 294/5.5 X |

*Primary Examiner*—Johnny D. Cherry

*Attorney, Agent, or Firm*—Cushman, Darby & Cushman

[57] ABSTRACT

A tobacco supporting tine structure comprising an elongated rod bent to define a relatively long longitudinally extending leg portion having a free end thereof shaped to facilitate a piercing movement thereof through a bulk mass of tobacco leaves, a bight portion extending transversely from the other end of the leg portion, a relatively short parallel section extending from the opposite end of the bight portion from which the leg portion extends in the same direction as the latter, a locking section extending transversely from the short parallel sections in a direction toward and at an angle of approximately 45° with respect to the leg portion and a relatively long leg section extending longitudinally from the locking section in generally coextensive parallel relation to the leg portion and having a free end shaped to facilitate a piercing movement thereof through a bulk mass of tobacco leaves.

11 Claims, 8 Drawing Figures

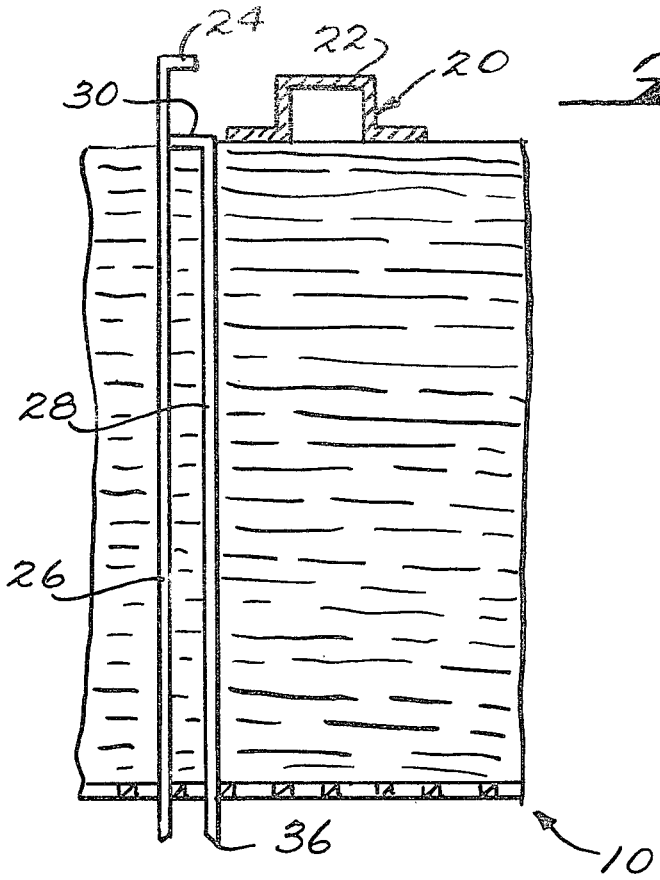
Fig. 4.
Fig. 5.
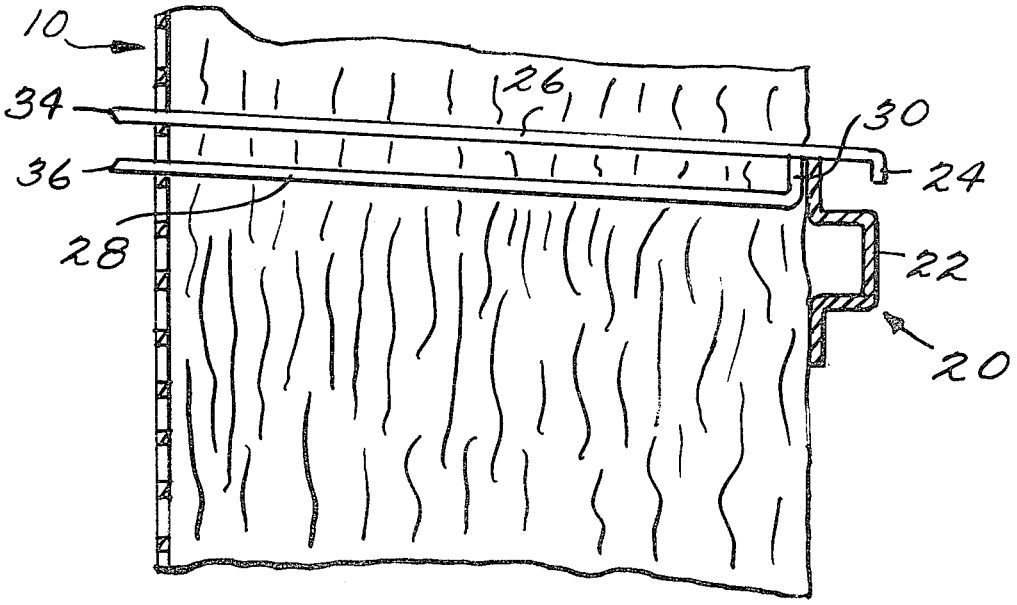

TOBACCO SUPPORTING TINE STRUCTURE WITH IMPROVED LOCKING MEANS

This invention relates to tobacco curing and more particularly to improvements in the tine structure used to support tobacco leaves in bulk condition during curing.

An example of the type of tine structure herein contemplated is disposed in my commonly assigned U.S. Pat. No. 4,136,465. For background purposes, the detailed disclosure of this patent is hereby incorporated by reference into the present specification. The tobacco curing system disclosed in the patent is of the bulk curing type in which each of the containers utilized to handle the leaves during curing is generally of a size or capacity greatly in excess of the size or capacity of conventional bulk curing racks (see Hassler U.S. Pat. No. 3,105,713 and No. 3,110,326, and also my patents No. 3,134,583 and No. 3,244,445). A characteristic of the large capacity containers such as disclosed in my aforesaid commonly assigned patent is that the tine structure utilized to provide interior support for the tobacco leaves during curing is separate from the container structure which receives the bulk mass of tobacco leaves and serves to peripherally confine the same during curing. The tine structure in my aforesaid patent is provided by a plurality of U-shaped tines each having a bight portion and a pair of generally parallel leg portions extending therefrom. In general it can be stated that the bight portion is provided to facilitate engagement and disengagement of the leg portions with the tobacco whereas the leg portions cooperate with the tobacco and container structure to provide the necessary interior support during curing.

The container structure disclosed is a container for receiving tobacco leaves while disposed in a horizontal loading position and for supporting the leaves for curing while disposed in a vertical curing position. The container when in the loading position comprises a horizontally extending bottom structure and a pair of side walls extending upwardly from the bottom structure in parallel relation with respect to one another. The bottom structure and the side walls define a curing space of a size comparable to a transverse section of a curing barn above the bottom structure and between the side walls which is open at the upper end thereof so that tobacco leaves can be filled downwardly in random fashion into supported relation to the bottom structure between the side walls and uniformly loaded into the curing space. The container also includes a top closure for securement between the side walls across the open upper end of the curing space after the tobacco leaves have been filled therein to provide with the bottom structure and the side walls peripheral confinement for the loaded tobacco leaves, as aforesaid. The leg portions of the U-shaped tines are of a length sufficient to extend from the top closure to the bottom structure. The free ends of the leg portions of the U-shaped tines are shaped to pierce completely through the loaded tobacco leaves peripherally confined in the curing space so as to be positioned adjacent the bottom structure when the associated bight portion is positioned adjacent the top closure whereby when the container is moved from its loading position into its curing position the U-shaped tines are positioned to be supported and to provide interior support for the peripherally confined tobacco leaves in the curing space during the curing operation.

While the arrangement is satisfactory in operation, one problem which occasionally arises is that following the movement of the container from its loading position into its curing position, the position of a tine may be shifted longitudinally outwardly to an extent such that the free ends thereof are no longer in supporting relation to the bottom structure of the container. When this happens and it is not corrected it is possible that the adjacent portion of the tobacco leaves engaged by such tine may likewise shift so as to disturb the generally uniform leaf density of the mass of leaves being cured, resulting in non-uniformity of the final cure.

It is an object of the present invention to provide an improvement in such a tine-container arrangement which will obviate the problem described above. In accordance with the principles of the present invention this objective is accomplished by providing each U-shaped tine with locking means operable after the leg portions thereof have been pierced completely through the loaded tobacco leaves as aforesaid to engage downwardly and inwardly of the top closure of the container in response to the movement of the container from its loading position into its curing position so as to prevent unwanted longitudinally outward movement of the leg portions before and during curing. Preferably, the locking means is in the form of a short transverse section associated with one of the leg portions. Preferably, such section is provided by bending the aforesaid one leg portion so that it includes a relatively short parallel section extending from the bight portion to one end of the transverse locking section and a relatively long leg section extending from the other end of the transverse locking section in generally coextensive parallel relation with the other leg portion. Preferably, the locking sections extend transversely toward and at an angle of approximately 45° with respect to the other leg portion.

A further object of the present invention is the provision of a tine structure of the type described having improved locking means therein for preventing unwanted longitudinally outward movement thereof during operation.

Another object of the present invention is the provision of a tobacco supporting tine structure which is simple in construction, effective in operation and economical to manufacture.

These and other objects of the present invention will become more apparent during the course of the following detailed description and appended claims.

The invention may best be understood with reference to the accompanying drawings, wherein an illustrative embodiment is shown.

In the drawings:

FIG. 4 is an enlarged fragmentary sectional view taken along the line 4—4 of FIG. 1;

FIG. 5 is a view similar to FIG. 4 showing the position of the parts after the container has been moved from its loading position into its curing position;

Figure 1:
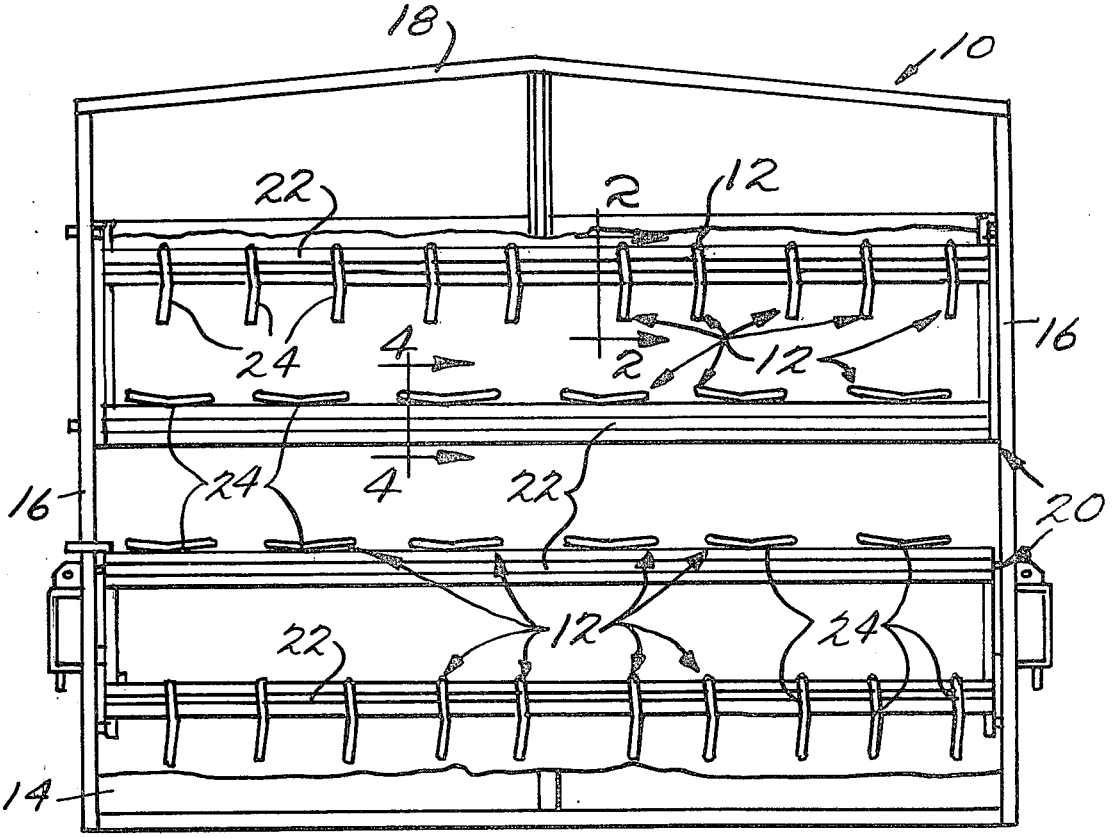
FIG. 1 is a top plan view of a container disposed in its loading position showing the improved tines of the present invention operatively associated therewith.
Figure 6:
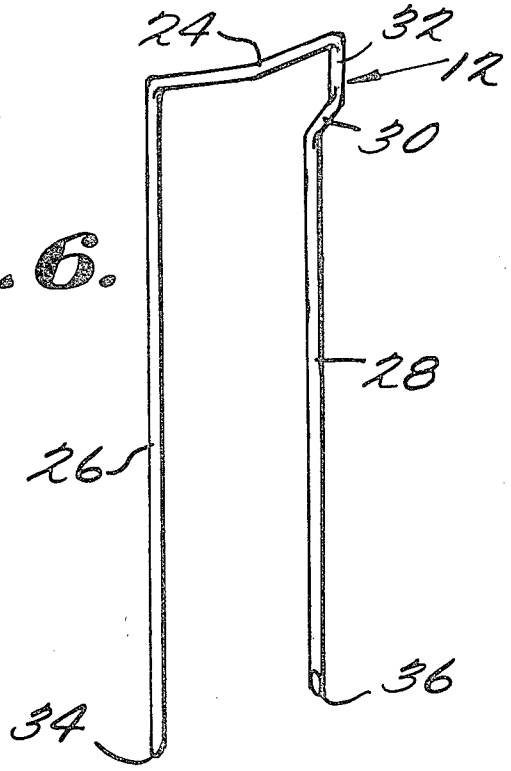
FIG. 6 is a perspective view of a tine structure embodying the principles of the present invention.

Referring now more particularly to the drawings, there is shown in FIG. 1 thereof a container, generally indicated at 10, which is constructed and operated in accordance with the teachings contained in my aforesaid U.S. Pat. No. 4,136,465 and a multiplicity of tine structures, generally indicated at 12, embodying the principles of the present invention, the tine structures being shown in cooperating relation with the container 10 when disposed in its loading position.

The container 10, as disclosed in the aforesaid patent, forms a section of a bulk tobacco curing barn (not shown), the barn being a composite construction assembled from a plurality of individual containers 10 mounted on a concrete floor or the like having a furnace section (not shown) at one end thereof. The barn sections are mounted in an outwardly extending horizontal row relationship with respect to the furnace section and the composite assembly also includes an outer end door section which closes the outermost barn section so that a circulation of heated air through the supported tobacco can be maintained by the furnace section.

The container 10 is adapted to be disposed in a horizontal loading position, as shown in FIG. 1, and to be moved from such horizontal loading position into a vertical curing position. The container 10 when in its horizontal loading position as shown in FIG. 1 includes a horizontally extending bottom structure 14 (see FIGS. 2–5) which preferably is formed of a sheet of expanded metal suitably reinforced by horizontally extending frame members, and a pair of side walls 16 extending upwardly from the bottom structure 14 in parallel relation with respect to one another. As shown, the side walls 16 are imperforate and formed of laminations which include insulating means so as to constitute side wall sections of the composite barn, all of which is fully disclosed in the aforesaid patent to which reference may be had if desired.

The bottom structure 14 and side walls 16 define a curing space of a size comparable to a transverse section of a curing barn above the bottom structure and between the side walls which is open at the upper end thereof so that tobacco leaves can be filled downwardly in random fashion into supported relation to the bottom structure between the side walls and uniformly loaded into the curing space. In accordance with the teachings contained in the aforesaid patent, the container 10 also includes a roof defining wall 18 of pitched configuration extending between one end of the side walls. The roof defining wall 18 is likewise formed of a heat insulating laminated construction and provides a roof section of the composite barn when assembled.

The container 10 also includes top closure means, generally indicated at 20. In the embodiment shown, the top closure means includes a pair of pivoted gate-like structures, each including a pair of transversely extending top closure members 22. In accordance with the teachings contained in the aforesaid patent, each gate structure of the top closure means 20 is adapted to be disposed in an open position when the container 10 is in it horizontal loading position. After the curing space of the container has been loaded with tobacco leaves, the gate structures of the top closure means are pivotable from the open position into a closed position wherein the top closure members 22 are disposed generally parallel with the bottom structure 14. It will be understood that suitable means (not shown) is provided for releasably locking the top closure members in their closed position. Referring now more particularly to FIGS. 2–6, each tine 12 is generally of U-shaped configuration and includes a bight portion 24 and two generally parallel leg portions 26 and 28 extending from opposite ends thereof. Preferably, each tine 12 is formed of an elongated metallic rod bent to define the aforesaid two leg portions 26 and 28 and bight portion 24. In accordance with the principles of the present invention, each tine 12 is formed with a locking means operable after the same has been moved into pierced relationship with respect to the leaves loaded in a closed container 10 to engage, in response to the movement of the container from its horizontal loading position into its vertical curing position, downwardly and inwardly of an associated top closure member 22 so as to prevent unwanted longitudinally outward movement of the tine 12 during the curing operation. As shown, preferably the locking means is in the form of a transversely extending section 30 within one of the leg portions, such as leg portion 28. The leg portion 28 thus includes a relatively short parallel section 32 which extends from the associated end of the bight portion 24 in parallel relation to the leg portion 26 to one end of the transverse locking section 30. The relatively long remaining section of the leg portion 28 extends from the opposite end of the transverse locking portion 30 and constitutes a leg section which is disposed in generally co-extensive parallel relationship with respect to the other leg portion 26. The locking section 30 extends between the short parallel section 32 and the leg section of the leg portion 28 in a direction toward and at an angle of approximately 45° with respect to the leg portion 26.

It will be understood that each of the leg portions 26 and 28 includes a free end, 34 and 36 respectively, which is shaped to facilitate the piercing movement of the tine through a bulk mass of tobacco leaves loaded within the curing space of the container 10. In addition, it will be noted that the bight portion 24 of each tine 12 is bent so as to be formed by two angularly related straight sections defining an angle therebetween of approximately 161°.

Referring now more particularly to FIG. 1, a preferred manner of placing the multiplicity of tines 12 into cooperating relation with respect to the container 10 and a bulk mass of tobacco leaves loaded therein is illustrated. In this regard it will be noted that the tines 12 which are disposed in cooperating relation with respect to the uppermost and lowermost top closure members 22 are engaged within the leaves so that when the container 10 is moved into its vertical curing position the leg portions 28 are disposed above the top closure member and the leg portions 26 are disposed below the associated top closure member with the associated bight portions 24 extending generally vertically. In contrast, the tines 12 mounted in cooperating relationship with respect to the middle two top closure members 22 are mounted so that when the container 10 is moved into its vertical curing position both leg portions 26 and 28 are disposed above the associated top closure member with the associated bight portions 24 extending generally horizontally.

Figure 2:
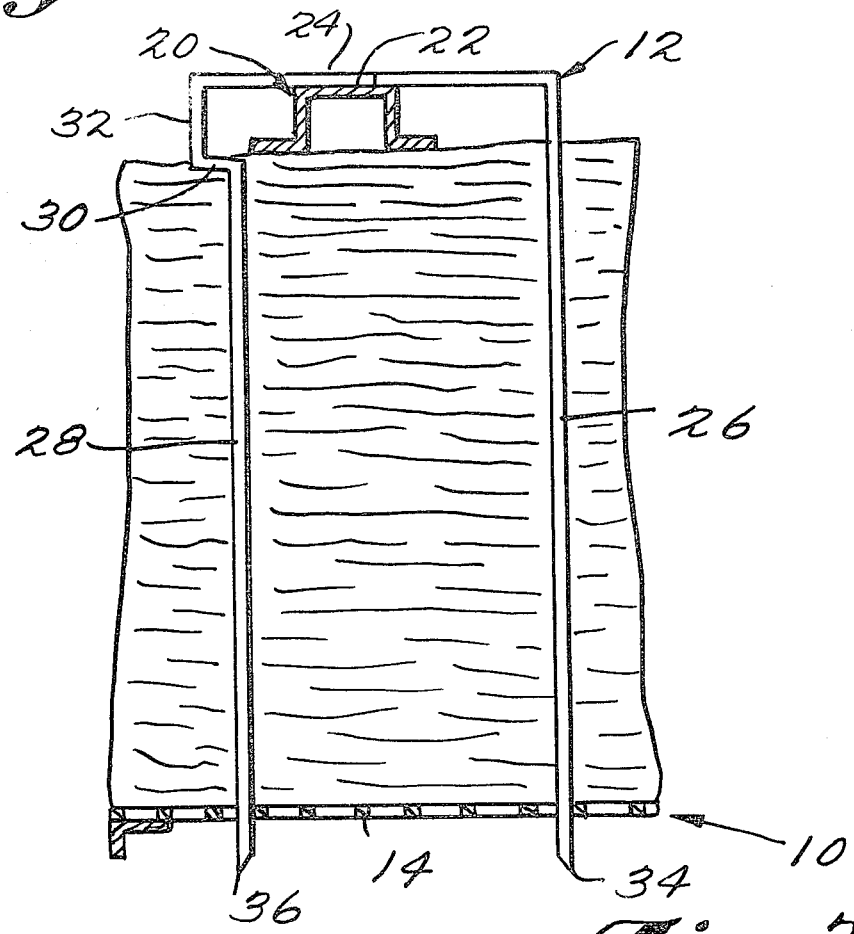
FIG. 2 is an enlarged fragmentary sectional view taken along the line 2—2 of FIG. 1.

FIG. 2 illustrates the manner in which the tines 12 associated with the upper and lower top closure members 22 are initially moved into cooperating relation with respect to the tobacco leaves within the curing space of the container 10 when in its horizontal loading position. It will be noted that each tine 12 is moved generally rectilinearly downwardly by the operator manually gripping the bight portion 24 from an initial position above the container into the operative position shown in FIG. 2. Care must be exercised by the operator to orient each tine so that in its initial position the pointed free end 36 of the leg portion 28 is adjacent the surface of the associated top closure member 22 which defines the upper surface thereof when the container is moved into its vertical curing position. It will be noted that when the tine 12 has been moved into its fully engaged operative position, the pointed free ends 34 and 36 of the leg portions 26 and 28 extend through the perforated screen forming the bottom structure 14 of the container 10. The inner surface of the bight portion 24 of each tine is disposed in engagement with the associated outer surface of the top closure member 22 so as to limit the longitudinally inward movement of each tine 12. It will also be noted that the length of each short section 32 is so related to the thickness dimension of the associated top closure member 22 as to dispose the locking section 30 in a vertical position slightly below the inner surface of the top closure member 22.

Figure 3:
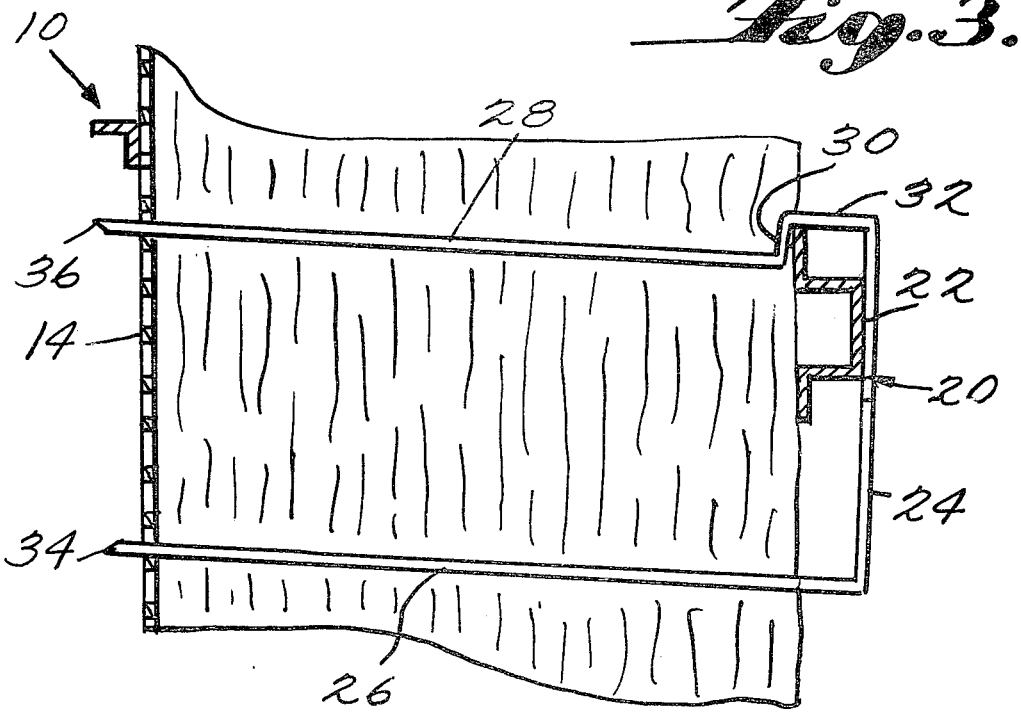
FIG. 3 is a view similar to FIG. 2 showing the position of the parts after the container has been moved from its loading position into its curing position.

FIG. 3 illustrates the position each tine 12 assumes in response to the movement of the container 10 from the horizontal loading position shown in FIG. 2 to the vertical curing position thereof. In this regard it will be noted that each locking section 30 has moved downwardly with respect to the associated top closure member 22 by the weight of the tobacco leaves supported thereby so that the locking section 30 is engaged downwardly and inwardly with respect to the associated top closure member 22. This engagement of each locking section effectively prevents the associated tine 12 from any unwanted longitudinally outward movement before the curing operation.

FIG. 4 illustrates the cooperative relationship between each of the tines 12 with respect to the inner two top closure members 22. Here again, each tine 12 is moved rectilinearly downwardly by the operator manually gripping the bight portion 24 from an initial position above the container into the operative position shown in FIG. 4. Again, care must be taken to orient each tine in its initial position so that the pointed free end 36 of the leg portion 28 is disposed adjacent the surface of the associated member 22 which becomes the upper surface thereof when the container 10 is moved into its vertical curing position. As before, it will be noted that when each tine 12 is in its operative position the free ends 34 and 36 of the leg portions 26 and 28 extend through the foraminous screen of the bottom structure 14. It will also be noted that the locking section 30 is disposed at a vertical level below the lower surface of the associated top closure member 22.

FIG. 5 illustrates the position which each tine 12 shown in FIG. 4 assumes in response to the movement of the container 10 from the horizontal loading position as shown in FIG. 4 into its vertical curing position. In this regard it will be noted that the weight of the tobacco leaves impaled on the leg portions of each tine has effected a downward movement of the locking section 30 so that the same is engaged downwardly and inwardly of the associated top closure member 22, thus preventing unwanted longitudinally outward movement of the tine 12 before the curing operation. The angular configuration of the bight portion 24 provides a means by which the extent of the longitudinally inward movement of each tine can be limited. Thus even though the angular bight portion does not engage the top closure member when the tine reaches the operative position shown, it will limit further inward movement after such engagement occurs.

Figure 7:
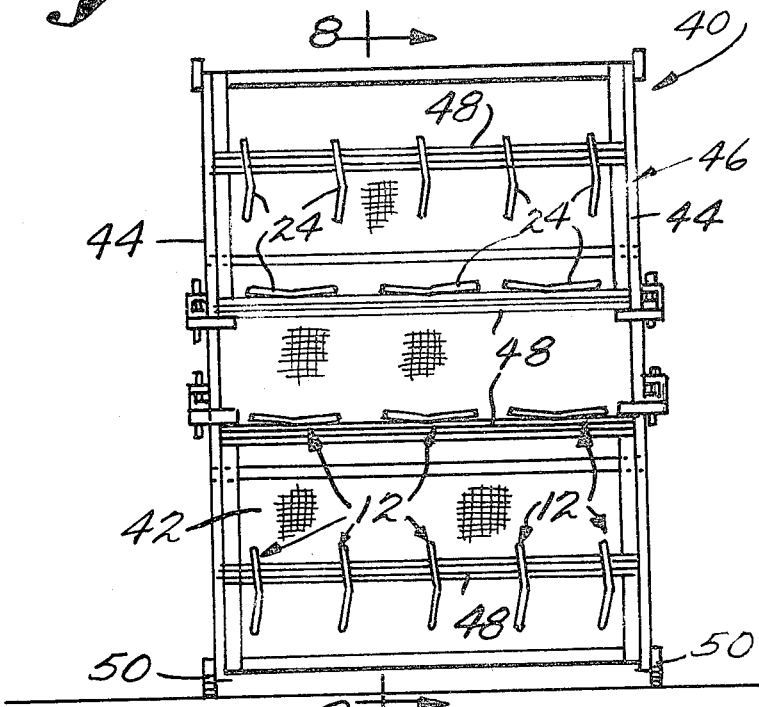
FIG. 7 is a front elevational view showing the tines cooperating with a container of a different configuration.
Figure 8:
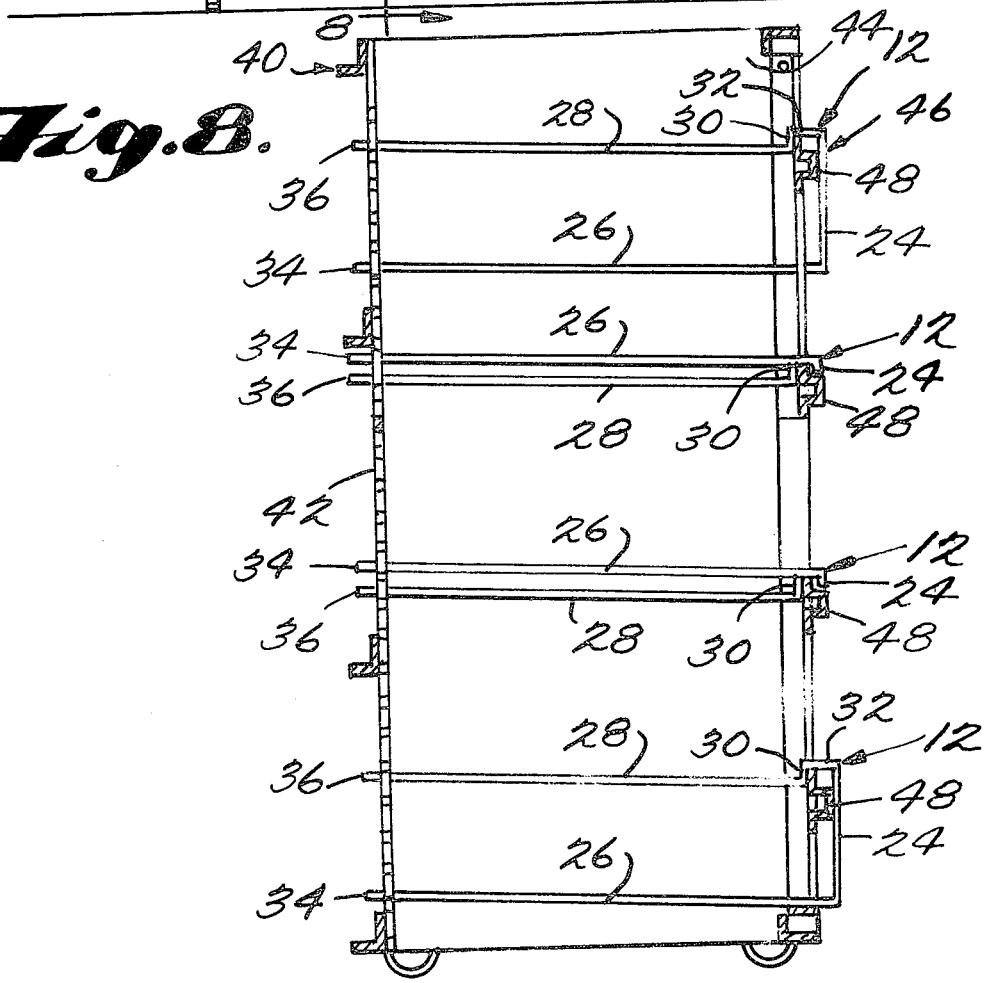
FIG. 8 is an enlarged fragmentary sectional view taken along the line 8—8 of FIG. 7.

FIGS. 7 and 8 illustrate a container, generally indicated at 40, of modified construction with which the tines 12 may also be utilized. The container 40 is of comparable capacity to the container 10. The container, however, is adapted to be moved within a pre-erected barn structure for curing rather than to form an integral part of a composite barn assembly, as is the container 10.

The container 40 is similar in function to the container 10 in that it is arranged to be disposed in a horizontal loading position for the purpose of loading a multiplicity of bulk tobacco leaves therein. The container 40, like the container 10, is adapted to be moved from its horizontal loading position into a vertical curing position. When in its horizontal loading position the container 40 includes a bottom structure 42 which is preferably constructed in a manner similar to the bottom structure 14. Extending upwardly from opposite side edges of the bottom structure 42 is a pair of side walls 44. As shown, the container 40 also includes a top closure means, generally indicated at 46, which is constructed in a manner similar to the top closure means 20. Thus, as shown, the top closure means 46 includes a pair of pivoted gate structures each including a pair of top closure members 48 movable between open and closed positions in a manner similar to the member 22.

The capacity of the container 40 is similar to the capacity of the container 10 in that the container 40 provides a curing space which is comparable to a transverse section of a curing barn. The basic difference between the container 40 and the container 10 is that the container 40, as aforesaid, is adapted to be moved in its vertical curing position into a pre-existing barn, whereas the container 10 is adapted to form a transverse section of a composite barn assembly itself. To facilitate the movement of the container 40 into a pre-existing barn, the container when in its vertical curing position is provided with a pair of rollers 50 along the lower edge of each of the side walls 44. It will be noted that the cooperation between the container 40 and the tines 12 is substantially identical as with the container 10.

It will be understood that the locking means of the present invention may assume other forms than the single locking section 30 which extends at a 45° angle. This construction is preferred since it can be simply formed and performs the locking function irrespective of the orientation of the tine with respect to the associated top closure member 22, as exemplified by the different orientations shown in FIGS. 2 and 3, as compared with those shown in FIGS. 4 and 5. A locking section could be embodied in each of the two leg portions to separately accommodate each of the two orientations. Likewise one or more locking sections could be provided by a separate rod or rods welded to one or both of the leg portions.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a container for receiving tobacco leaves while disposed in a horizontal loading position and for supporting the leaves for curing while disposed in a vertical curing position, said container when in said loading position comprising a horizontally extending bottom structure, a pair of side walls extending upwardly from said bottom structure in parallel relation with respect to one another, said bottom structure and said side walls defining curing space above said bottom structure and between said side walls which is open at the upper end thereof so that tobacco leaves can be filled downwardly in random fashion into supported relation to said bottom structure between said side walls and uniformly loaded into said curing space, top closure means for securement between said side walls across the open upper end of said curing space after the tobacco leaves have been filled therein to provide with said bottom structure and said side walls peripheral confinement for the loaded tobacco leaves, and a plurality of separate generally U-shaped tines, each of said U-shaped tines comprising a bight portion and a pair of generally parallel leg portions extending therefrom of a length sufficient to extend from said top closure means to said bottom structure, the free ends of the leg portions of said U-shaped tines being shaped to pierce completely through the loaded tobacco leaves peripherally confined in said curing space so as to be positioned adjacent the bottom structure when the associated bight portion is positioned adjacent said top closure means whereby when said container is moved from said loading position into said curing position said U-shaped tines are positioned to be supported and to provide interior support for the peripherally confined tobacco leaves in the curing space during the curing operation, the improvement which comprises each of said U-shaped tines including means spaced slightly from said bight portion operable after the leg portions thereof have been pierced completely through the loaded tobacco leaves as aforesaid to engage downwardly and inwardly of said top closure means in response to the movement of said container from said loading position into said curing position so as to prevent unwanted longitudinally outward movement of said leg portions before curing, said unwanted movement preventing means of each tine comprising a transversely extending locking section in one of said leg portions, said one leg portion of each tine including a relatively short parallel section extending from said bight portion to one end of said locking section and a leg section extending from the opposite end of said locking section.

2. The improvement as defined in claim 1 wherein said locking section extends from said short section in a direction toward and at an angle of approximately 45° with respect to the other of said leg portions.

3. The improvement as defined in claim 1 or 2 wherein the bight portion of each tine is bent to form two angularly related sections disposed generally within a single plane generally perpendicular to the longitudinal extent of said leg portions.

4. The improvement as defined in claim 3 wherein the angularly related sections of each bight portion define an angle of approximately 161° therebetween.

5. A tine structure for use with a container for receiving tobacco leaves while disposed in a horizontal loading position and for supporting the leaves for curing while disposed in a vertical curing position in which the container when in said loading position comprises a horizontally existing bottom structure, a pair of side walls extending upwardly from said bottom structure in parallel relation with respect to one another, said bottom structure and said side walls defining curing space above said bottom structure and between said side walls which is open at the upper end thereof so that tobacco leaves can be filled downwardly in random fashion into supported relation to said bottom structure between said side walls and uniformly loaded into said curing space, and top closure means for securement between said side walls across the open upper end of said curing space after the tobacco leaves have been filled therein to provide with said bottom structure and said side walls peripheral confinement for the loaded tobacco leaves, said tine structure comprising:

a generally U-shaped tine including a bight portion and a pair of generally parallel leg portions extending therefrom of a length sufficient to extend from the top closure means to the bottom structure of the container, the free ends of the leg portions of said U-shaped tine being shaped to pierce completely through the loaded tobacco leaves peripherally confined in the container curing space so as to be positioned adjacent the bottom structure thereof when the associated bight portion is positioned adjacent the top closure means thereof whereby when the container is moved from its loading position into its curing position said U-shaped tine is positioned to be supported and to provide adjacent interior support for the peripherally confined tobacco leaves in the curing space during the curing operation, said U-shaped tine having means spaced slightly from said bight portion operable after the leg portions thereof have been pierced completely through the loaded tobacco leaves as aforesaid to engage downwardly and inwardly of the top closure means in the container in response to the movement of the container from its loading position into its curing position so as to prevent unwanted longitudinally outward movement of said leg portions before curing, said unwanted movement preventing means comprising a transversely extending locking section in one of said leg portions, said one leg portion including a relatively short parallel section extending from said bight portion to one end of said locking section and a leg section extending from the opposite end of said locking section.

6. A tine structure as defined in claim 5 wherein said locking section extends from said short section in a direction toward and at an angle of approximately 45° with respect to the other of said leg portions.

7. A tine structure as defined in claim 5 or 6 wherein said bight portion is bent to form two angularly related sections disposed generally within a single plane generally perpendicular to the longitudinal extent of said leg portions.

8. A tine structure as defined in claim 7 wherein the angularly related sections of said bight portion defined an angle of approximately 161° therebetween.

9. A tobacco supporting tine structure comprising an elongated rod bent to define a relatively long longitudinally extending leg portion having a free end thereof shaped to facilitate a piercing movement thereof through a bulk mass of tobacco leaves, a bight portion extending transversely from the other end of said leg portion, a relatively short parallel section extending from the opposite end of said bight portion from which said leg portion extends in the same direction as the latter, a locking section extending transversely from said short parallel section in a direction toward and at an angle of approximately 45° with respect to said leg portion and a relatively long leg section extending longitudinally from said locking section in generally coextensive parallel relation to said leg portion and having a free end shaped to facilitate a piercing movement thereof through a bulk mass of tobacco leaves.

10. A tine structure as defined in claim 9 wherein said bight portion is bent to form two angularly related sections disposed generally within a single plane generally perpendicular to the longitudinal extent of said leg portion.

11. A tine structure as defined in claim 10 wherein the angularly related sections of said bight portion define an angle of approximately 161° therebetween.

* * * * *